US009194260B2

(12) United States Patent
Zurface

(10) Patent No.: US 9,194,260 B2
(45) Date of Patent: Nov. 24, 2015

(54) SWITCHING ROCKER ARM

(71) Applicant: Eaton Corporation, Cleveland, OH (US)

(72) Inventor: Austin Zurface, Hastings, MI (US)

(73) Assignee: Eaton Corporation, Cleveland, OH (US)

( * ) Notice: Subject to any disclaimer, the term of this patent is extended or adjusted under 35 U.S.C. 154(b) by 10 days.

(21) Appl. No.: 14/049,460

(22) Filed: Oct. 9, 2013

(65) Prior Publication Data

US 2014/0041608 A1 Feb. 13, 2014

Related U.S. Application Data

(63) Continuation-in-part of application No. 13/051,839, filed on Mar. 18, 2011, now Pat. No. 8,726,862, which is a continuation-in-part of application No. 13/051,848, filed on Mar. 18, 2011, now Pat. No. 8,752,513.

(60) Provisional application No. 61/315,464, filed on Mar. 19, 2010.

(51) Int. Cl.
*F01L 1/18* (2006.01)
*F01L 13/00* (2006.01)

(52) U.S. Cl.
CPC . *F01L 1/18* (2013.01); *F01L 1/185* (2013.01); *F01L 13/0005* (2013.01); *F01L 13/0036* (2013.01); *F01L 2001/186* (2013.01); *F01L 2105/00* (2013.01)

(58) Field of Classification Search
CPC .... F01L 1/18; F01L 13/0036; F01L 2001/186
USPC ..... 123/90.39, 90.44, 90.16
See application file for complete search history.

(56) References Cited

U.S. PATENT DOCUMENTS 5,655,488 A * 8/1997 Hampton et al. ..... 123/90.16
6,923,151 B2 * 8/2005 Kreuter ..... 123/90.16

(Continued)

FOREIGN PATENT DOCUMENTS

DE 102004017103 10/2005
DE 102006046573 4/2008

(Continued)

OTHER PUBLICATIONS

Office Action for related U.S. Appl. No. 13/051,848 dated Jul. 16, 2013.

(Continued)

*Primary Examiner* — Ching Chang
(74) *Attorney, Agent, or Firm* — Remarck Law Group PLC

(57) ABSTRACT

A switching rocker arm assembly can include an outer arm, an inner arm and a latch assembly. The outer arm can have one or more high lift lobe contacting surfaces, where each of the high lift lobe contacting surfaces has an uppermost point that defines an outer arm tangent plane. The inner arm can be pivotably secured to the outer arm and have a low lift lobe contacting surface. The low lift lobe contacting surface can have an uppermost point that defines an inner arm tangent plane that is parallel to the outer arm tangent plane. The inner arm tangent plane can be spaced from the outer arm tangent plane by a minimum distance. The latch assembly can be movable between a first configuration in which the outer arm rotates with the inner arm, and a second configuration in which the outer arm rotates independently from the inner arm.

20 Claims, 17 Drawing Sheets

(56) References Cited

U.S. PATENT DOCUMENTS

| | | | |
|---|---|---|---|
| 6,932,041 | B1 | 8/2005 | Riley |
| 7,562,643 | B2 | 7/2009 | Akasaka |
| 7,677,213 | B2 | 3/2010 | Deierlein |
| 7,987,826 | B2 | 8/2011 | Kwak Young et al. |
| 2003/0192497 | A1 | 10/2003 | Hendriksma et al. |
| 2003/0209217 | A1 | 11/2003 | Hendriksma et al. |
| 2004/0074459 | A1 | 4/2004 | Hayman et al. |
| 2005/0016480 | A1 | 1/2005 | Ferracin et al. |
| 2005/0188930 | A1 | 9/2005 | Best |
| 2007/0039573 | A1 | 2/2007 | Deierlein |
| 2007/0125329 | A1 | 6/2007 | Rohe et al. |
| 2007/0186890 | A1 | 8/2007 | Zurface et al. |
| 2008/0149059 | A1 | 6/2008 | Murphy et al. |
| 2009/0000882 | A1 | 1/2009 | Siebke |
| 2011/0226208 | A1 | 9/2011 | Zurface et al. |

FOREIGN PATENT DOCUMENTS

| | | |
|---|---|---|
| DE | 102006057895 | 6/2008 |
| EP | 1785595 | 5/2007 |
| JP | 2008184956 | 8/2008 |

OTHER PUBLICATIONS

International Search Report issued by the European Patent Office; PCT/US2011/029065; Authorized Officer Paulson, B.; Issued Sep. 21, 2011 (3 pages).

Written Opinion issued by the European Patent Office; PCT/US2011/029065; Authorized Officer Paulson, B.; Issued Sep. 21, 2011 (6 pages).

International Search Report issued by the European Patent Office; PCT/US2011/029061; Authorized Officer Paulson, B.; Issued Sep. 21, 2011 (3 pages).

Written Opinion issued by the European Patent Office; PCT/US2011/029061; Authorized Officer Paulson, B.; Issued Sep. 21, 2011 (6 pages).

Office Action for related U.S. Appl. No. 13/051,839 dated Jun. 20, 2013.

* cited by examiner

SWITCHING ROCKER ARM

CROSS-REFERENCE TO RELATED APPLICATIONS

This application is a continuation-in-part of U.S. patent application Ser. No. 13/051,839 filed on Mar. 18, 2011, which claims priority to U.S. Provisional Application No. 61/315,464 filed on Mar. 19, 2010. This application is also a continuation-in-part of U.S. patent application Ser. No. 13/051,848 filed on Mar. 18, 2011 which also claims priority to U.S. Provisional Application No. 61/315,464 filed on Mar. 19, 2010. These applications are incorporated by reference in their entirety as if set forth herein.

FIELD

This application is directed to switching rocker arms for internal combustion engines.

BACKGROUND

Switching rocker arms allow for control of valve actuation by alternating between two or more states, usually involving multiple arms, such as in inner arm and outer arm. In some circumstances, these arms engage different cam lobes, such as low-lift lobes, high-lift lobes, and no-lift lobes. Mechanisms are required for switching rocker arm modes in a manner suited for operation of internal combustion engines.

SUMMARY

According to various embodiments of the present disclosure, a switching rocker arm assembly is disclosed. The rocker arm assembly can include an outer arm and an inner arm. The outer arm can have a first outer side arm and a second outer side arm. Each of the first and second outer side arms can have a high lift lobe contacting surface, where each of the high lift lobe contacting surfaces has an uppermost point that defines an outer arm tangent plane. The inner arm can be disposed between the first and second outer side arms and pivotably secured to the outer arm. The inner arm can have a low lift lobe contacting surface and define a latch bore. The low lift lobe contacting surface can have an uppermost point that defines an inner arm tangent plane that is parallel to the outer arm tangent plane.

A latch assembly can be arranged at least partially within the latch bore of the inner arm. The latch assembly can be movable between a first configuration and a second configuration. The latch assembly can be configured to: (i) engage with the outer arm such that the outer arm rotates with the inner arm in the first configuration, and (ii) disengage the inner arm from the outer arm such that the outer arm rotates independently from the inner arm in the second configuration. In some configurations, the inner arm tangent plane can be spaced from the outer arm tangent plane by a minimum distance.

According to various alternative embodiments of the present disclosure, an internal combustion engine is disclosed. The engine can include a lash adjuster mounted to an engine block, and a cylinder valve configured to selectively open and close an exhaust or intake passage. The engine can further include a rocker arm assembly coupled to the lash adjuster at a first end and engaged with the cylinder valve at a second end opposite the first end. The rocker arm assembly can include an outer arm and an inner arm. The outer arm can have a first outer side arm and a second outer side arm. Each of the first and second outer side arms can include a high lift lobe contacting surface. The inner arm can be disposed between the first and second outer side arms and be pivotably secured to the outer arm. The inner arm can further have a low lift lobe contacting surface.

The engine can further include a latch assembly selectively movable between a first configuration and a second configuration. The latch assembly can be configured to: (i) engage the inner arm with the outer arm such that the outer arm rotates with the inner arm in the first configuration, and (ii) disengage the inner arm from the outer arm such that the outer arm rotates independently from the inner arm in the second configuration.

The engine can also include a cam having a low lift lobe and two high lift lobes. Each of the low and high lift lobes can include an actuating portion and a non-actuating portion. The cam can rotate during operation of the internal combustion engine such that the actuating portions interact with the rocker arm assembly to rotate at least one of the inner and outer arms. The non-actuating portions of the high lift lobes can be in a spaced relation from the high lift lobe contacting surfaces.

In various further embodiments of the present disclosure, an internal combustion engine is disclosed. The engine can include a lash adjuster, a cylinder valve, a rocker arm assembly and a cam. The lash adjuster can be mounted to an engine block and the cylinder valve can be configured to selectively open and close an exhaust or intake passage.

The rocker arm assembly can be coupled to the lash adjuster at a first end and engaged with the cylinder valve at a second end opposite the first end. The rocker arm assembly can include a first arm having a first lobe contacting surface and a second arm pivotably secured to the first arm and having a second lobe contacting surface. The rocker arm assembly can further include a latch assembly selectively movable between a first configuration and a second configuration. The latch assembly can be configured to: (i) engage the first arm with the second arm such that the second arm rotates with the first arm in the first configuration, and (ii) disengage the second arm from the first arm such that the second arm rotates independently from the first arm in the second configuration.

The cam can have a first lobe and a second lobe. Each of the first and second lobes can include an actuating portion and a non-actuating portion. The cam can be rotated during operation of the internal combustion engine such that the actuating portions interact with the rocker arm assembly to rotate at least one of the first and second arms. Further, the non-actuating portion of the second lobe can be in a spaced relation from the second lobe contacting surface.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

It will be appreciated that the illustrated boundaries of elements in the drawings represent only one example of the boundaries. One of ordinary skill in the art will appreciate that a single element may be designed as multiple elements or that multiple elements may be designed as a single element. An element shown as an internal feature may be implemented as an external feature and vice versa.

Further, in the accompanying drawings and description that follow, like parts are indicated throughout the drawings and description with the same reference numerals, respectively. The figures may not be drawn to scale and the proportions of certain parts have been exaggerated for convenience of illustration.

DETAILED DESCRIPTION

Figure 1:
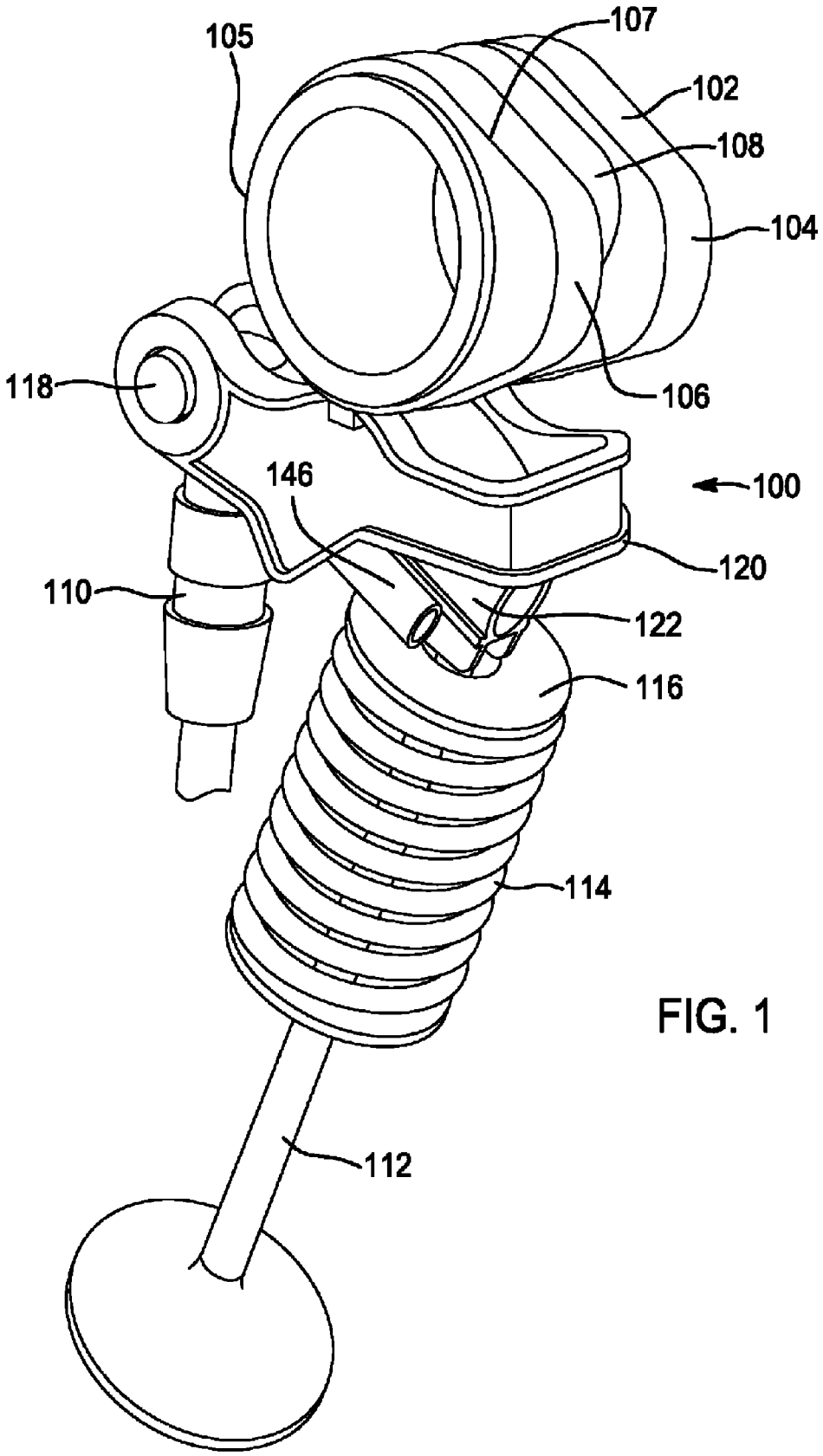
FIG. 1 illustrates a perspective view of an exemplary switching rocker arm 100 as it may be configured during operation with a three lobed cam 102 in a non-actuating condition.

Certain terminology will be used in the following description for convenience in describing the figures will not be limiting. The terms "upward," "downward," and other directional terms used herein will be understood to have their normal meanings and will refer to those directions as the drawing figures are normally viewed.

FIG. 1 illustrates a perspective view of an exemplary switching rocker arm 100 as it may be configured during operation with a three lobed cam 102, a lash adjuster 110, valve 112, spring 114 and spring retainer 116. The cam 102 has a first and second high-lift lobe 104, 106 and a low lift lobe 108. The switching rocker arm has an outer arm 120 and an inner arm 122. During high lift operation, the high lift lobes 104, 106 contact the outer arm 120 while the low lift lobe contacts the inner arm 122. The lobes cause periodic downward movement of the outer arm 120 and inner arm 122. The downward motion is transferred to the valve 112 by inner arm 122, thereby opening the valve. Rocker arm 100 is switchable between a high lift mode and a low lift mode. In the high lift mode, the outer arm 120 is latched to the inner arm 122. During engine operation, the high lift lobes 104, 106 periodically push the outer arm 120 downward. Because the outer arm 120 is latched to the inner arm 122, the high lift motion is transferred from outer arm 120 to inner arm 122 and further to the valve 112. When the rocker arm 100 is in low lift mode, the outer arm 120 is not latched to the inner arm 122, and so high lift movement exhibited by the outer arm 120 is not transferred to the inner arm 122. Instead, the low lift lobe 108 contacts the inner arm 122 and generates low lift motion that is transferred to the valve 112. When unlatched from inner arm 122, the outer arm 120 pivots about a pivot axle 118, but does not transfer motion to valve 112.

Figure 2:
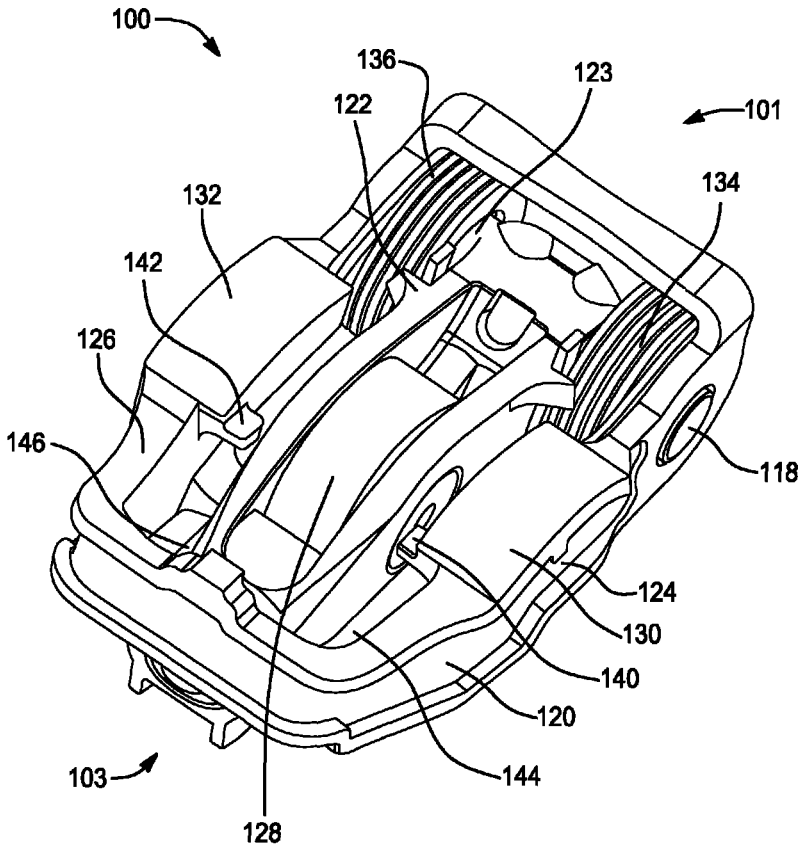
FIG. 2 illustrates a perspective view of an exemplary switching rocker arm 100.

FIG. 2 illustrates a perspective view of an exemplary switching rocker arm 100. The switching rocker arm 100 is shown by way of example only and it will be appreciated that the configuration of the switching rocker arm 100 that is the subject of this disclosure is not limited to the configuration of the switching rocker arm 100 illustrated in the figures contained herein.

As shown in FIG. 2, the switching rocker arm 100 includes an outer arm 120 having a first outer side arm 124 and a second outer side arm 126. An inner arm 122 is disposed between the first outer side arm 124 and second outer side arm 126. The inner arm 122 and outer arm 120 are both mounted to a pivot axle 118, located adjacent the first end 101 of the rocker arm 100, which secures the inner arm 122 to the outer arm 120 while also allowing a rotational degree of freedom about the pivot axle 118 of the inner arm 122 with respect to the outer arm 120. In addition to the illustrated embodiment having a separate pivot axle 118 mounted to the outer arm 120 and inner arm 122, the pivot axle 118 may be part of the outer arm 120 or the inner arm 122.

The rocker arm 100 illustrated in FIG. 2 has a roller 128 that is configured to engage a central low-lift lobe 108 of a three-lobed cam 102. First and second slider pads 130, 132 of outer arm 120 are configured to engage the first and second high-lift lobes 104, 106 shown in FIG. 1. First and second torsion springs 134, 136 function to bias the outer arm 120 upwardly after being displaced by the high lift lobes 104, 106. First and second over-travel limiters 140, 142 prevent over-coiling of the torsion springs 134, 136 and exceeding the stress capability of the springs 134, 136. The over-travel limiters 140, 142 may contact the first and second oil gallery 144, 146 in an overspeed condition during low-lift mode. At this point, the interference between the over-travel limiters 140, 142 and the galleries 144, 146 stops any further downward rotation of the outer arm 120.

Figure 3:
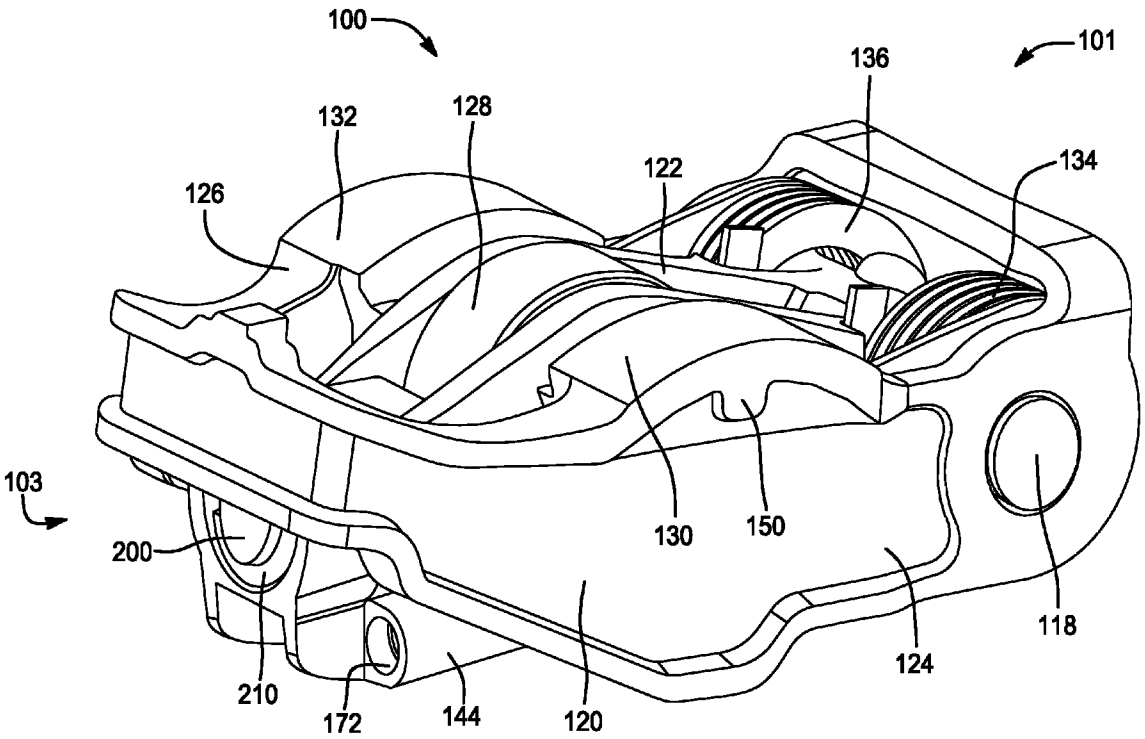
FIG. 3 illustrates another perspective view of an exemplary switching rocker arm 100.

FIG. 3 illustrates another perspective view of the rocker arm 100. A first clamping lobe 150 protrudes from underneath the first slider pad 130. A second clamping lobe (not shown) is similarly placed underneath the second slider pad 132. During the manufacturing process, clamping lobes 150 are engaged by clamps during grinding of the slider pads 130, 132. Grinding of these surfaces requires that the pads 130, 132 remain parallel to one another and that the outer arm 120 not be distorted. Clamping at the clamping lobes 150 prevents distortion that may occur to the outer arm 120 under other clamping arrangements. For example, clamping at the clamping lobe 150, which are preferably integral to the outer arm 120, assist in eliminating any mechanical stress that may occur by clamping that squeezes outer side arms 124, 126 toward one another. In another example, the location of clamping lobe 150 immediately underneath slider pads 130, 132, results in substantially zero to minimal torque on the outer arm 120 caused by contact forces with the grinding machine. In certain applications, it may be necessary to apply pressure to other portions in outer arm 120 in order to minimize distortion.

Figure 4:
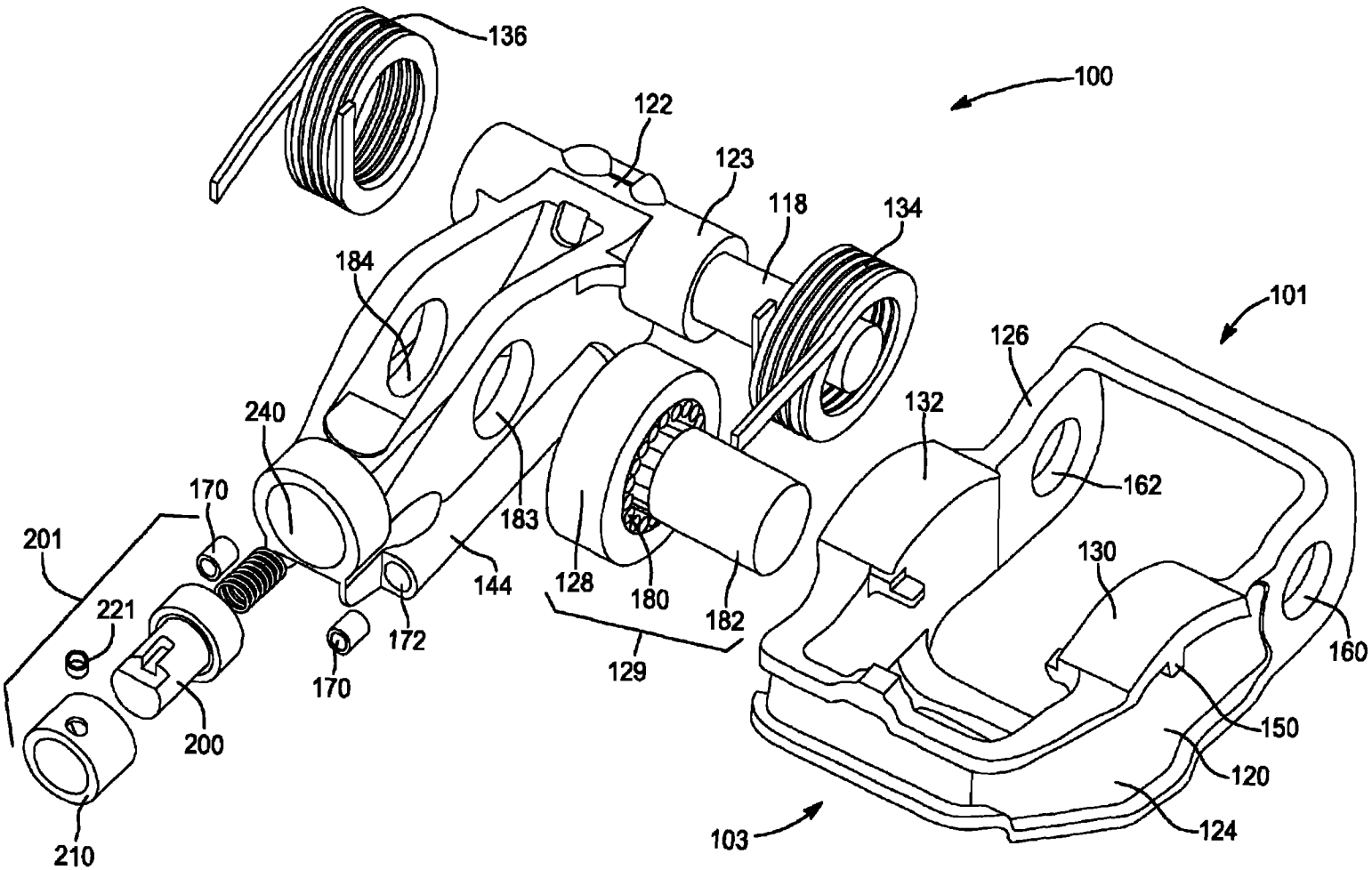
FIG. 4 illustrates an exploded view of an exemplary switching rocker arm 100.

FIG. 4 illustrates an exploded view of the switching rocker arm 100 of FIGS. 1-3. As shown in FIG. 4, when assembled, roller 128 is part of a needle roller-type assembly 129, having needles 180 mounted between the roller 128 and roller axle 182. Roller axle 182 is mounted to the inner arm 122 via roller axle apertures 183, 184. Roller assembly 129 serves to transfer the rotational motion of the low-lift cam 108 to the inner rocker arm 122, and in turn transfer motion to the valve 112 in the unlatched state. Pivot axle 118 is mounted to inner arm 122 through collar 123 and to outer arm 120 through pivot axle apertures 160, 162 at the first end 101 of rocker arm 100. Lost motion rotation of the outer arm 120 relative to the inner arm 122 in the unlatched state occurs about pivot axle 118. Lost motion movement in this context means movement of the outer arm 120 relative to the inner arm 122 in the unlatched state. This motion does not transmit the rotating motion of the first and second high-lift lobe 104, 106 of the cam 102 to the valve 112 in the unlatched state.

Other configurations other than the roller assembly 129 and pads 130, 132 also permit the transfer of motion from cam 102 to rocker arm 100. For example, a smooth non-rotating surface (not shown) such as pads 130, 132 may be placed on inner arm 122 to engage low-lift lobe 108, and roller assemblies may be mounted to rocker arm 100 to transfer motion from high-lift lobes 104, 106 to outer arm 120 of rocker arm 100. Further, it should be appreciated that other configurations of the roller assembly 129 than those illustrated can be utilized with this disclosure, e.g., utilizing multiple roller assemblies 129 or a single roller assembly 129 with multiple rollers 128.

The mechanism 201 for latching inner arm 122 to outer arm 120, which in the illustrated embodiment is found near second end 103 of rocker arm 100, is shown in FIG. 4 as comprising latch pin 200, sleeve 210, orientation pin 221, and latch spring 230. The mechanism 201 is configured to be mounted inside inner arm 122 within bore 240. As explained below, in the assembled rocker arm 100 latch 200 is extended in high-lift mode, securing inner arm 122 to outer arm 120. In low-lift mode, latch 200 is retracted into inner arm 122, allowing lost motion movement of outer arm 120. Oil pressure provided through the first and second oil gallery 144, 146, which may be controlled, for example, by a solenoid, controls whether latch 200 is latched or unlatched. Plugs 170 are inserted into gallery holes 172 to form a pressure tight seal closing first and second oil gallery 144, 146 and allowing them to pass oil to latching mechanism 201.

Figure 5:
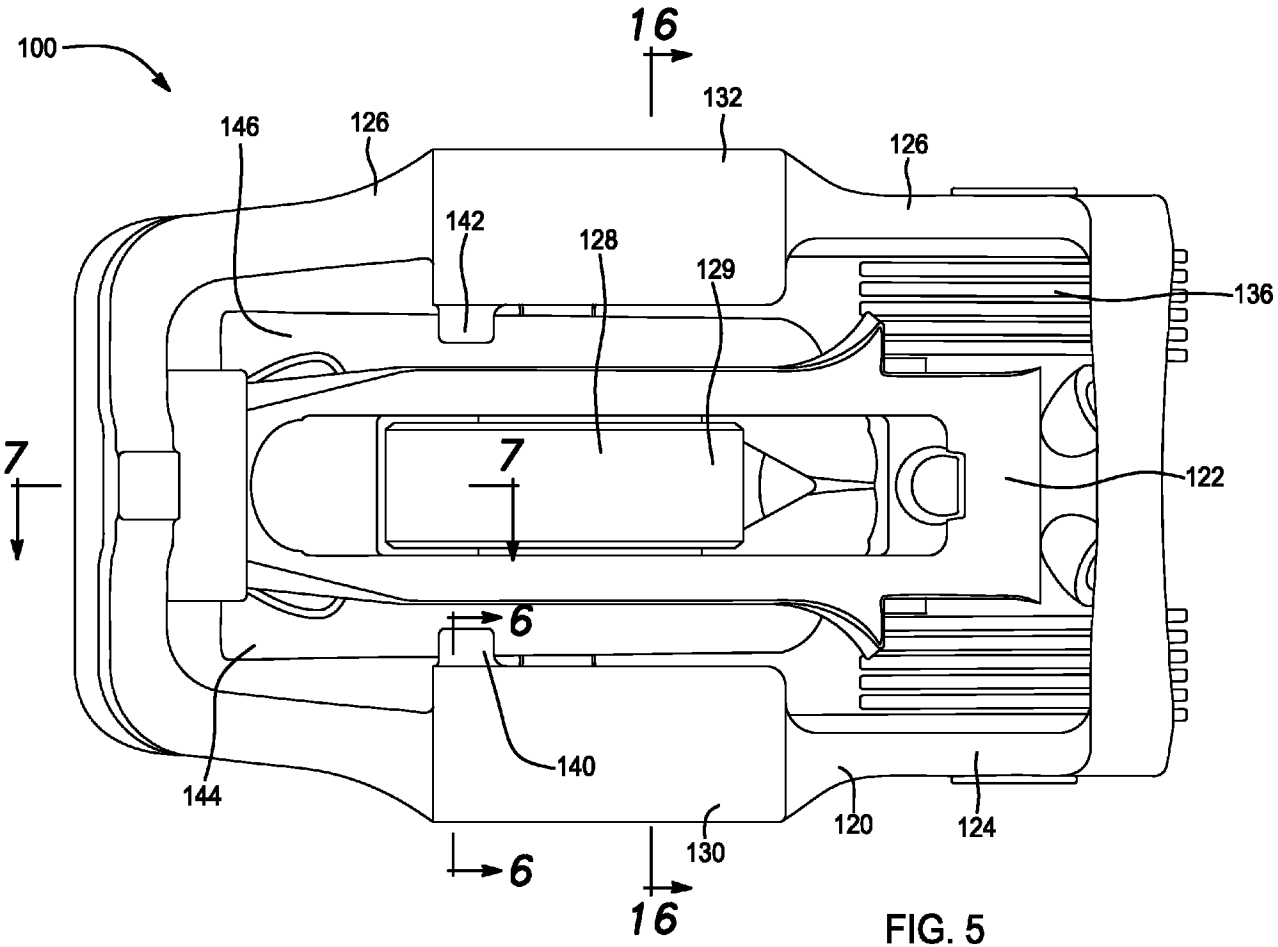
FIG. 5 illustrates a top-down view of exemplary switching rocker arm 100.
Figure 6:
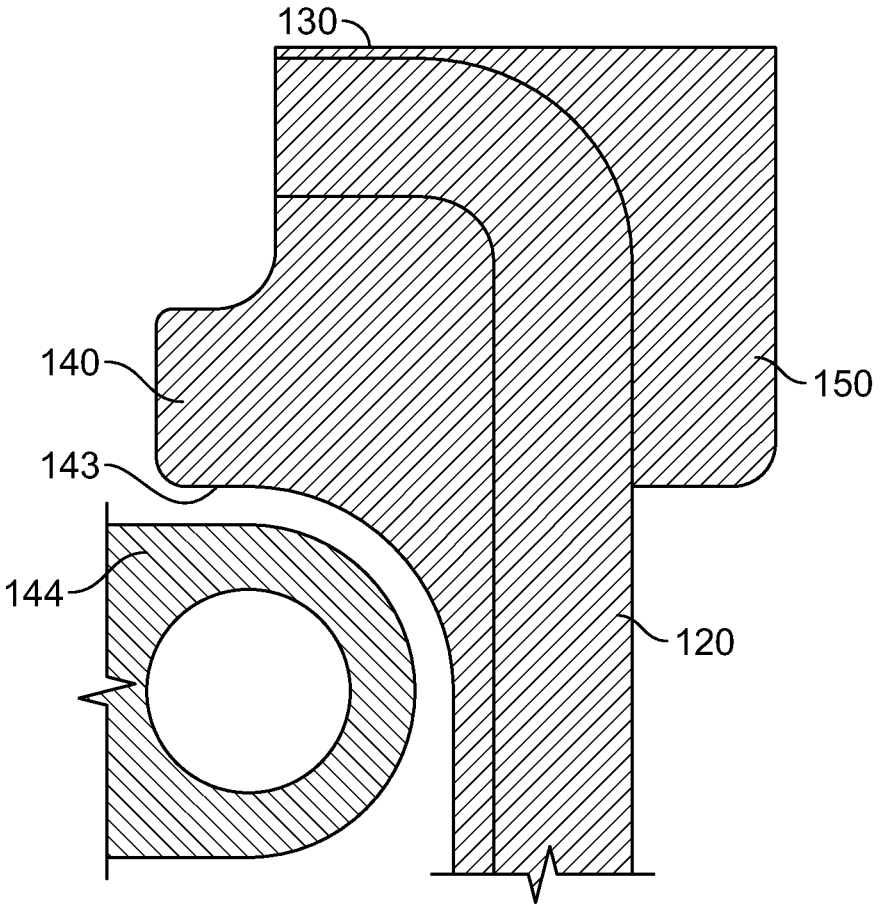
FIG. 6 illustrates a cross-section view taken along line 6-6 in FIG. 5.

FIG. 5 illustrates a top-down view of rocker arm 100. As shown in FIG. 5, over-travel limiters 140, 142 extend from outer arm 120 toward inner arm 122 to overlap with galleries 144, 146, ensuring interference between limiters 140, 142 and galleries 144, 146. As shown in FIG. 6, representing a cross-section view taken along line 6-6, contacting surface 143 of limiter 140 is contoured to match the cross-sectional shape of gallery 144. This assists in applying even distribution of force when limiters 140, 142 make contact with galleries 144, 146.

Figure 7:
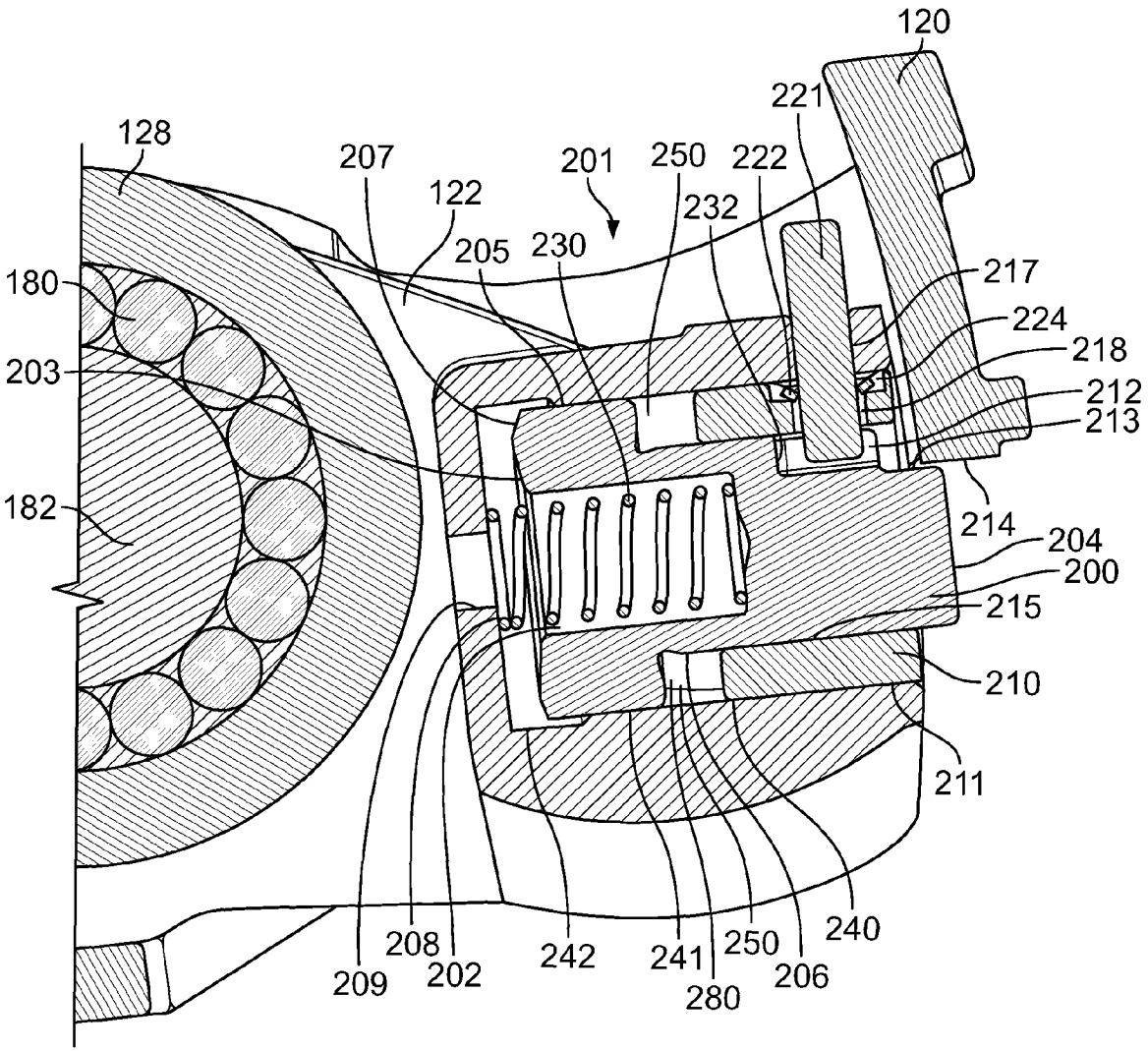
FIG. 7 illustrates a cross-sectional view of the latching mechanism 201 in its latched state along the line 7-7 in FIG. 5.

FIG. 7 illustrates a cross-sectional view of the latching mechanism 201 in its latched state along the line 7-7 in FIG. 5. A latch 200 is disposed within bore 240. Latch 200 has a spring bore 202 in which biasing spring 230 is inserted. The latch 200 has a rear surface 203 and a front surface 204. Latch 200 also has a first generally cylindrical surface 205 and a second generally cylindrical surface 206. First generally cylindrical surface 205 has a diameter larger than that of the second generally cylindrical surface 206. Spring bore 202 is generally concentric with surfaces 205, 206.

Sleeve 210 has a generally cylindrical outer surface 211 that interfaces a first generally cylindrical bore wall 241, and a generally cylindrical inner surface 215. Bore 240 has a first generally cylindrical bore wall 241, and a second generally cylindrical bore wall 242 having a larger diameter than first generally cylindrical bore wall 241. The generally cylindrical outer surface 211 of sleeve 210 and first generally cylindrical surface 205 of latch 200 engage first generally cylindrical bore wall 241 to form pressure tight seals. Further, the generally cylindrical inner surface 215 of sleeve 210 also forms a pressure tight seal with second generally cylindrical surface 206 of latch 200. These seals allow oil pressure to build in volume 250, which encircles second generally cylindrical surface 206 of latch 200.

The default position of latch 200, shown in FIG. 7, is the latched position. Spring 230 biases latch 200 outwardly from bore 240 into the latched position. Oil pressure applied to volume 250 retracts latch 200 and moves it into the unlatched position. Other configurations are also possible, such as where spring 230 biases latch 200 in the unlatched position, and application of oil pressure between bore wall 208 and rear surface 203 causes latch 200 to extend outwardly from the bore 240 to latch outer arm 120.

In the latched state, latch 200 engages a latch engaging surface 214 of outer arm 120 with arm engaging surface 213. As shown in FIG. 7, outer arm 120 is impeded from moving downward and will transfer motion to inner arm 122 through latch 200. An orientation feature 212 takes the form of a channel into which orientation pin 221 extends from outside inner arm 122 through first pin opening 217 and then through second pin opening 218 in sleeve 210. The orientation pin 221 is generally solid and smooth. A retainer 222 secures pin 221 in place. The orientation pin 221 prevents excessive rotation of latch 200 within bore 240.

Figure 8:
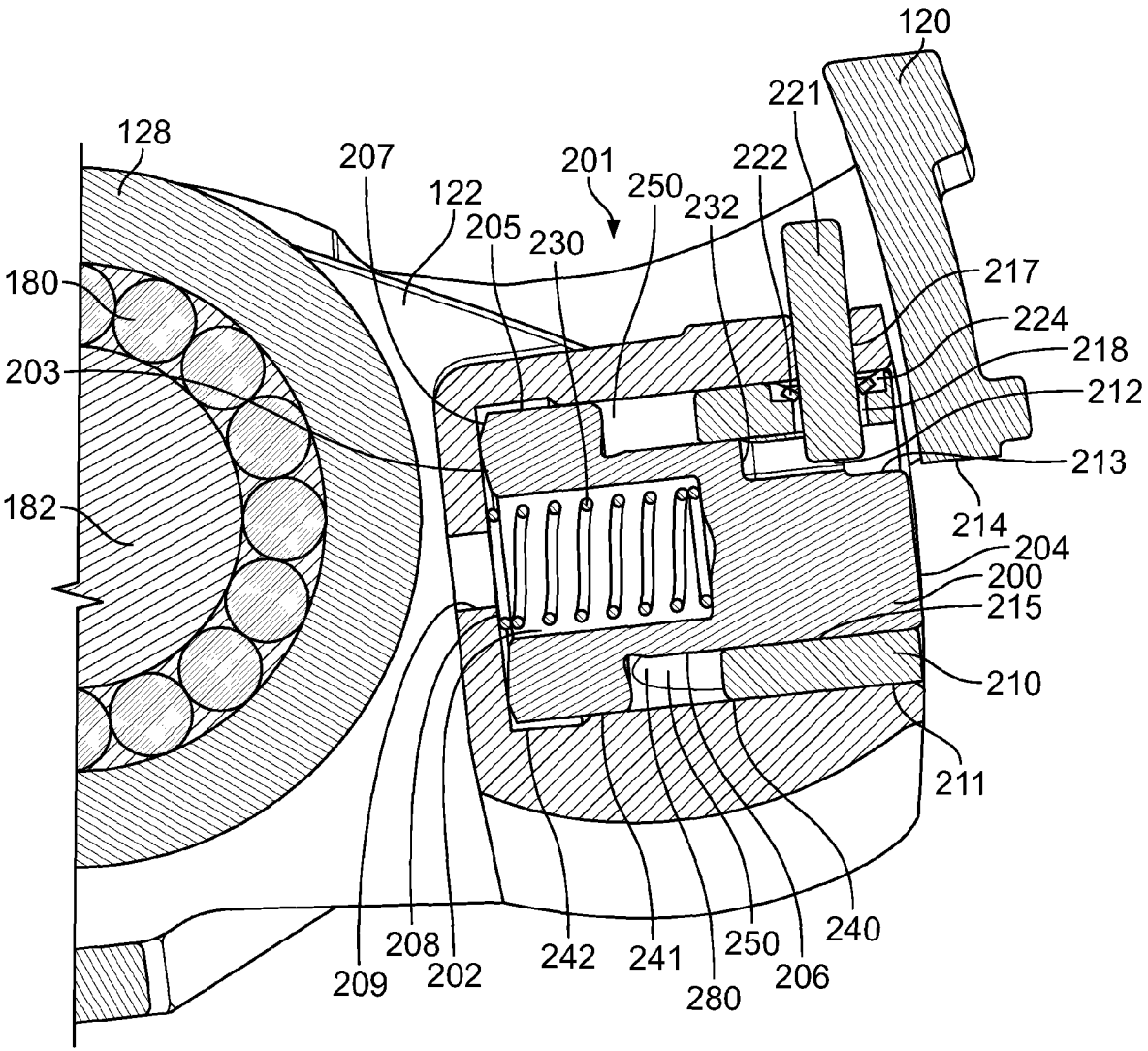
FIG. 8 illustrates a cross-sectional view of the latching mechanism 201 in its unlatched state.

As can be seen in FIG. 8, upon introduction of pressurized oil into volume 250, latch 200 retracts into bore 240, allowing outer arm 120 to undergo lost motion rotation with respect to inner arm 122. The outer arm 120 is then no longer impeded by latch 200 from moving downward and exhibiting lost motion movement. Pressurized oil is introduced into volume 250 through oil opening 280, which is in fluid communication with oil galleries 144, 146. As latch 200 retracts, it encounters bore wall 208 with its rear surface 203. In one preferred embodiment, rear surface 203 of latch 200 has a flat annular or sealing surface 207 that lies generally perpendicular to first and second generally cylindrical bore wall 241, 242, and parallel to bore wall 208. The flat annular surface 207 forms a seal against bore wall 208, which reduces oil leakage from volume 250 through the seal formed by first generally cylindrical surface 205 of latch 200 and first generally cylindrical bore wall 241.

Figure 9B:
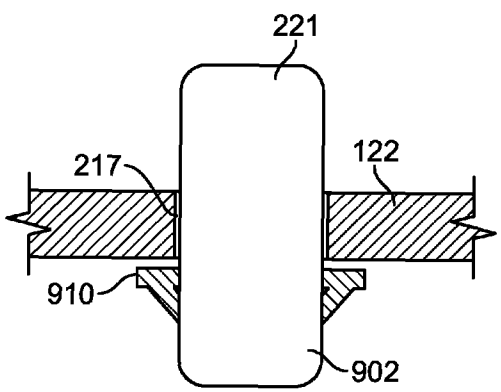
FIGS. 9A-9F illustrate several retention devices for orientation pin 221.
Figure 9C:
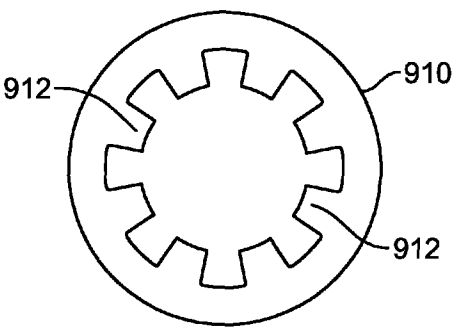
Figure 9A:
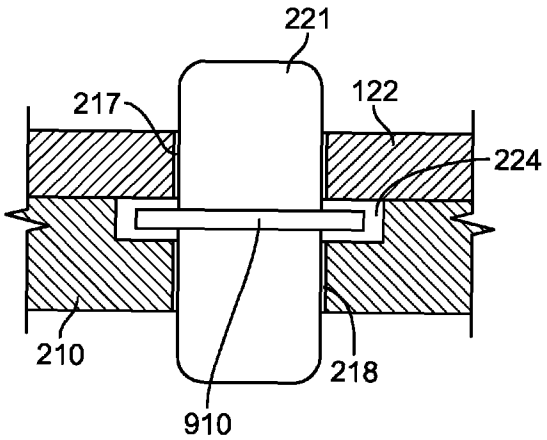
Figure 9E:
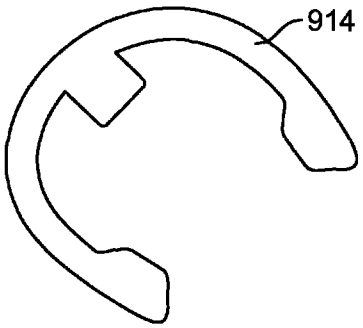
Figure 9D:
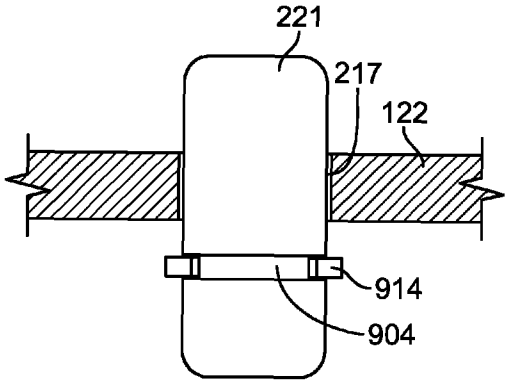
Figure 9F:
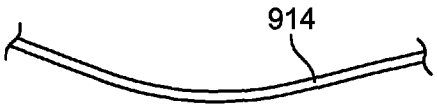

FIGS. 9A-9F illustrate several retention devices for orientation pin 221. In FIG. 9A, pin 221 is cylindrical with a uniform thickness. A push-on ring 910, as shown in FIG. 9C is located in recess 224 located in sleeve 210. Pin 221 is inserted into ring 910, causing teeth 912 to deform and secure pin 221 to ring 910. Pin 221 is then secured in place due to the ring 910 being enclosed within recess 224 by inner arm 122. In another embodiment, shown in FIG. 9B, pin 221 has a slot 902 in which teeth 912 of ring 910 press, securing ring 910 to pin 221. In another embodiment shown in FIG. 9D, pin 221 has a slot 904 in which an E-styled clip 914 of the kind shown in FIG. 9E, or a bowed E-styled clip 914 as shown in FIG. 9F may be inserted to secure pin 221 in place with respect to inner arm 122. In yet other embodiments, wire rings may be used in lieu of stamped rings. During assembly, the E-styled clip 914 is placed in recess 224, at which point the sleeve 210 is inserted into inner arm 122, then, the orientation pin 221 is inserted through the clip 910.

Figure 10:
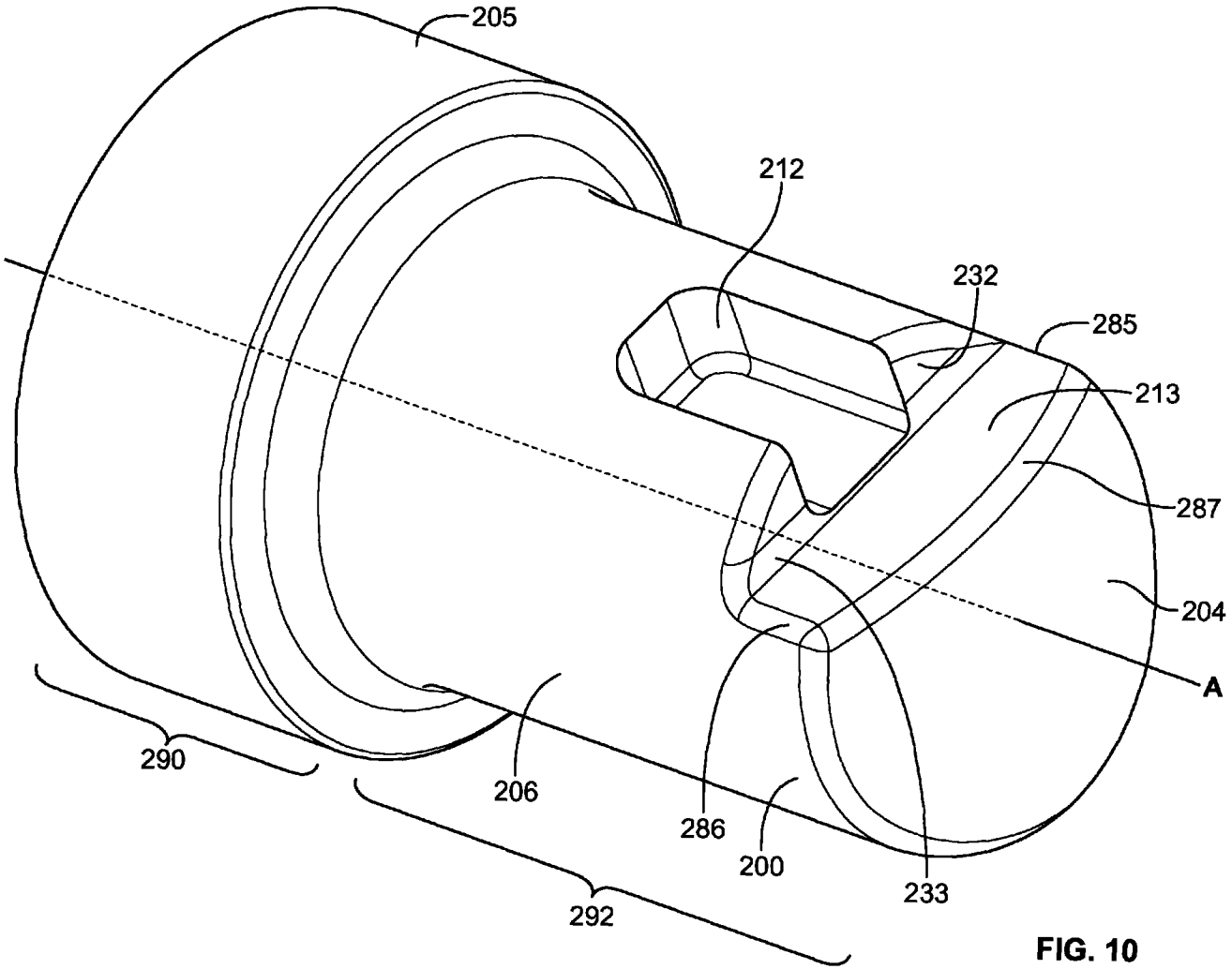
FIG. 10 illustrates an exemplary latch 200.

An exemplary latch 200 is shown in FIG. 10. The latch 200 is generally divided into a head portion 290 and a body portion 292. The front surface 204 is a protruding convex curved surface. This surface shape extends toward outer arm 120 and results in an increased chance of proper engagement of arm engaging surface 213 of latch 200 with outer arm 120. Arm engaging surface 213 comprises a generally flat surface. Arm engaging surface 213 extends from a first boundary 285 with second generally cylindrical surface 206 to a second boundary 286, and from a boundary 287 with the front surface to a boundary 233 with surface 232. The portion of arm engaging surface 213 that extends furthest from surface 232 in the direction of the longitudinal axis A of latch 200 is located substantially equidistant between first boundary 285 and second boundary 286. Conversely, the portion of arm engaging surface 213 that extends the least from surface 232 in the axial direction A is located substantially at first and second boundaries 285, 286. Front surface 204 need not be a convex curved surface but instead can be a v-shaped surface, or some other shape. The arrangement permits greater rotation of the latch 200 within bore 240 while improving the likelihood of proper engagement of arm engaging surface 213 of latch 200 with outer arm 120.

Figure 11:
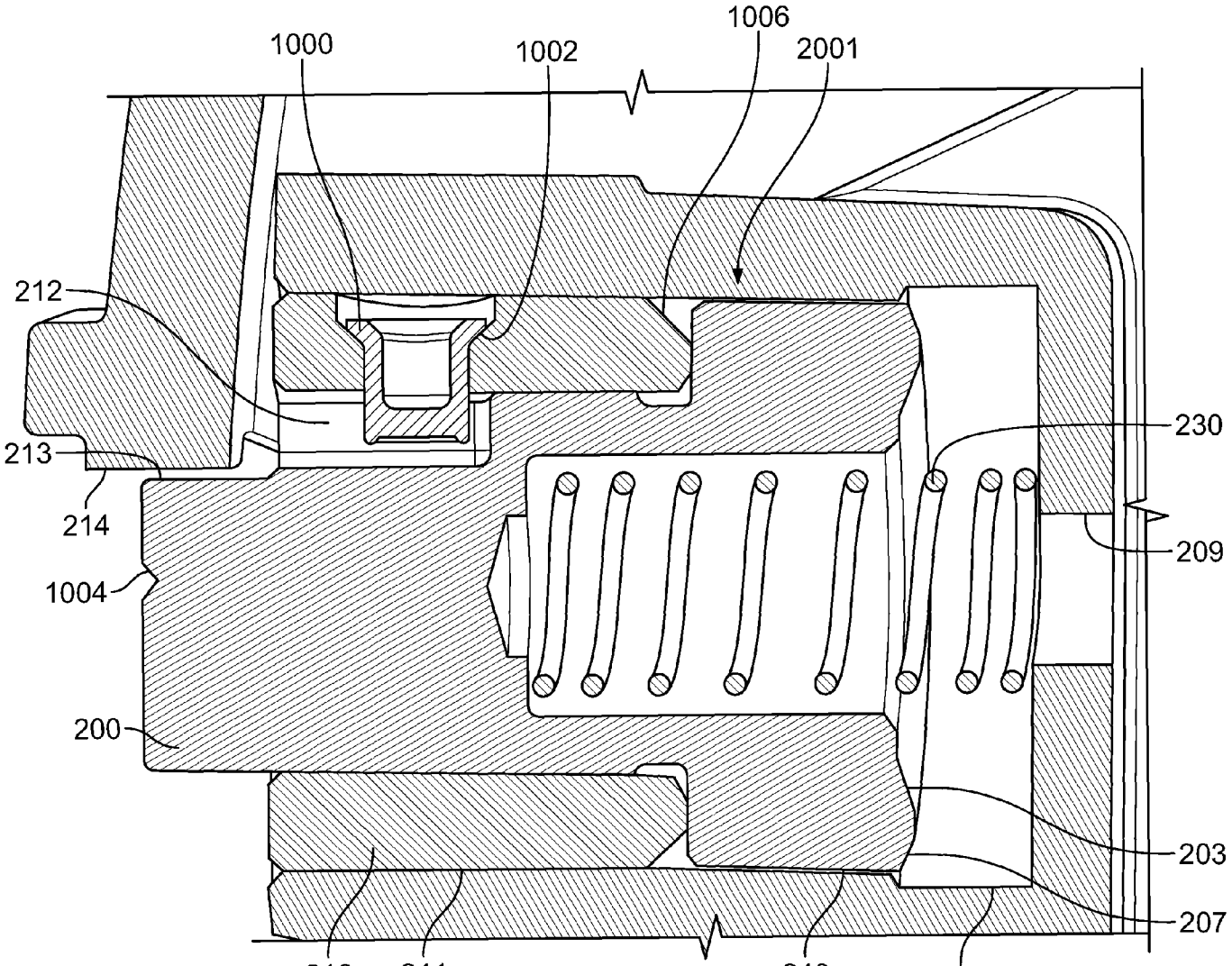
FIG. 11 illustrates an alternative latching mechanism 201.

An alternative latching mechanism 201 is shown in FIG. 11. An orientation plug 1000, in the form of a hollow cup-shaped plug, is press-fit into sleeve hole 1002 and orients latch 200 by extending into orientation feature 212, preventing latch 200 from rotating excessively with respect to sleeve 210. As discussed further below, an aligning slot 1004 assists in orienting the latch 200 within sleeve 210 and ultimately within inner arm 122 by providing a feature by which latch 200 may be rotated within the sleeve 210. The alignment slot 1004 may serve as a feature with which to rotate the latch 200, and also to measure its relative orientation.

Figure 13:
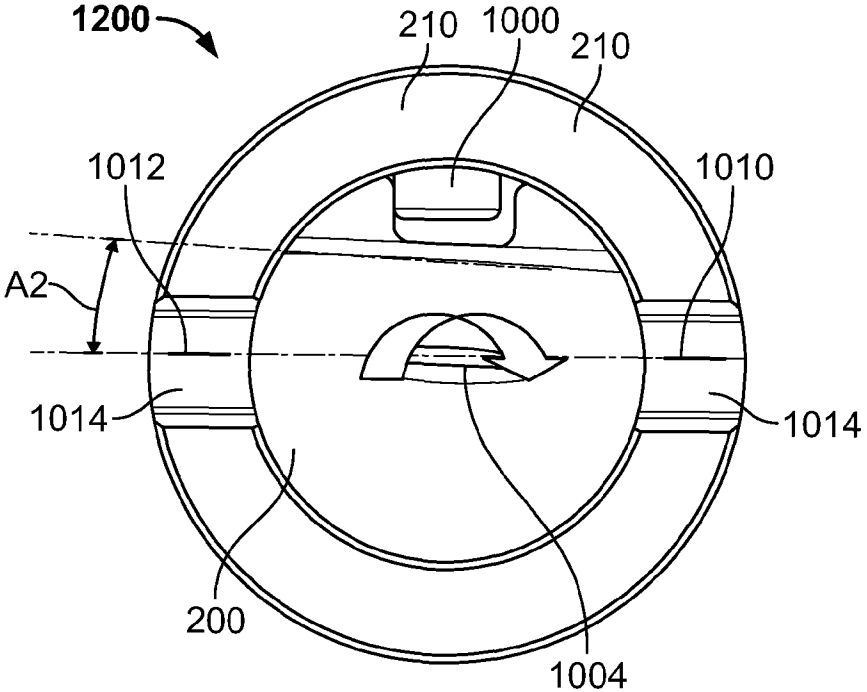
FIGS. 12-14 illustrate an exemplary method of assembling a switching rocker arm.
Figure 12:
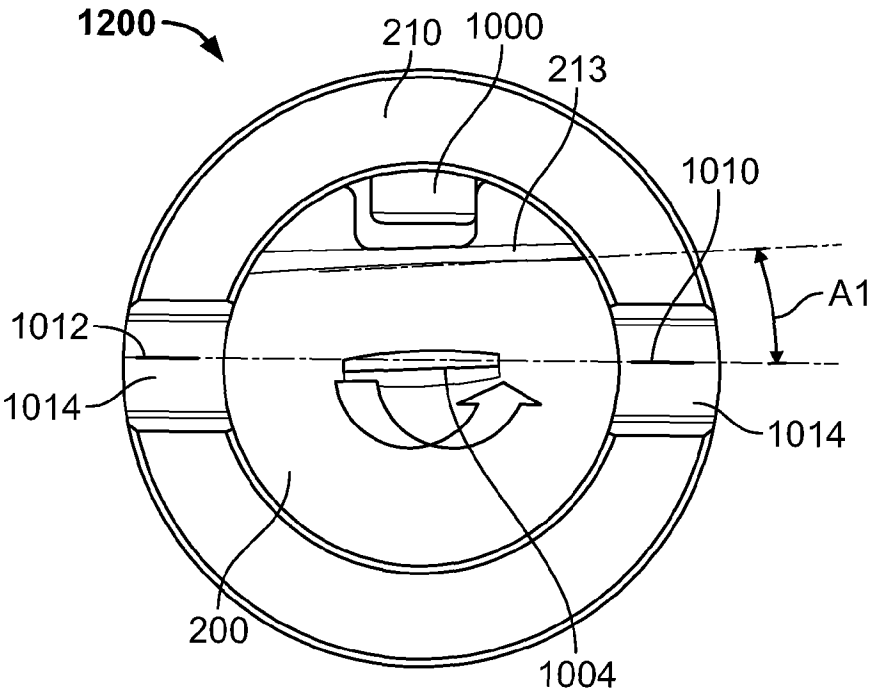
Figure 14:
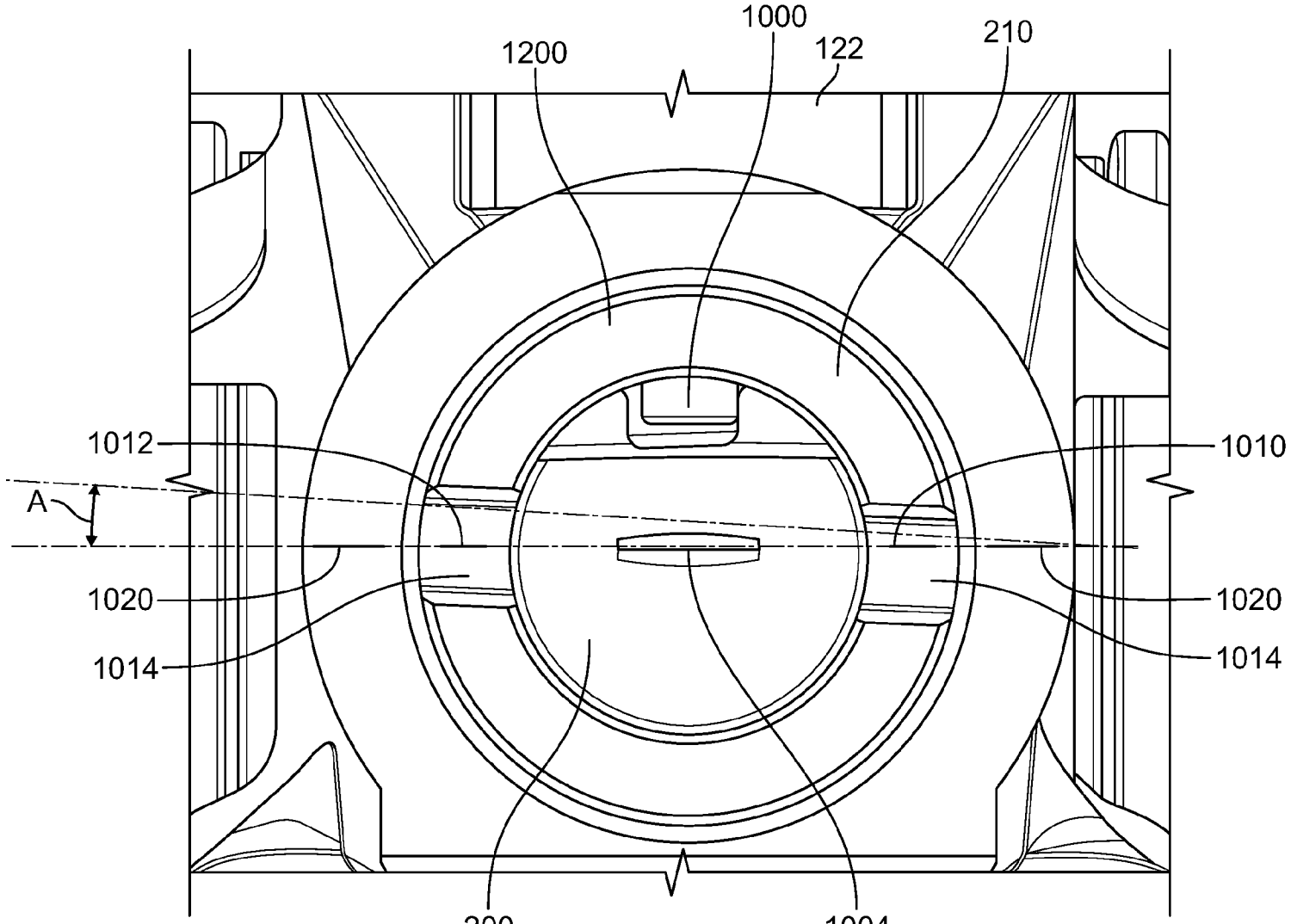

With reference to FIGS. 12-14, an exemplary method of assembling a switching rocker arm 100 is as follows: The orientation plug is press-fit into sleeve hole 1002 and latch 200 is inserted into generally cylindrical inner surface 215 of sleeve 210. The latch pin 200 is then rotated clockwise until orientation feature 212 reaches plug 1000, at which point interference between the orientation feature 212 and plug 1000 prevents further rotation. An angle measurement A1, as shown in FIG. 12, is then taken corresponding to the angle between arm engaging surface 213 and sleeve references 1010, 1012, which are aligned to be perpendicular to sleeve hole 1002. Aligning slot 1004 may also serve as a reference line for latch 200, and key slots 1014 may also serve as references located on sleeve 210. The latch pin 200 is then rotated counterclockwise until orientation feature 212 reaches plug 1000, preventing further rotation. As seen in FIG. 13, a second angle measurement A2 is taken corresponding to the angle between arm engaging surface 213 and sleeve references 1010, 1012. Rotating counterclockwise and then clockwise is also permissible in order to obtain A1 and A2. As shown in FIG. 14, upon insertion into the inner arm 122, the sleeve 210 and pin subassembly 1200 is rotated by an angle A as measured between inner arm references 1020 and sleeve references 1010, 1012, resulting in the arm engaging surface 213 being oriented horizontally with respect to inner arm 122, as indicated by inner arm references 1020. The amount of rotation A should be chosen to maximize the likelihood the latch 200 will engage outer arm 120. One such example is to rotate subassembly 1200 to an angle half of the difference of A2 and A1 as measured from inner arm references 1020. Other amounts of adjustment A are possible within the scope of the present disclosure.

Figure 15:
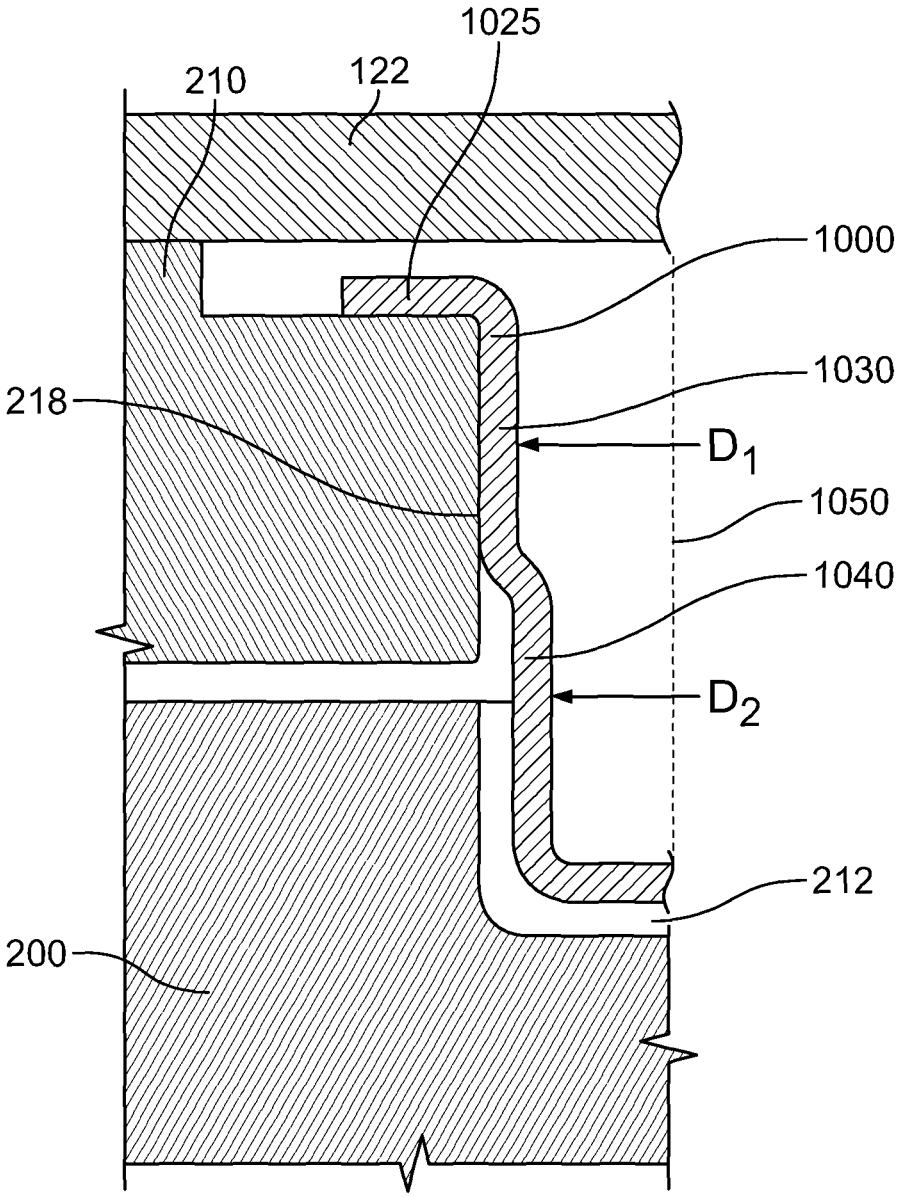
FIG. 15 illustrates an alternative embodiment of pin 1000.

A profile of an alternative embodiment of pin 1000 is shown in FIG. 15. Here, the pin 1000 is hollow, partially enclosing an inner volume 1050. The pin has a substantially cylindrical first wall 1030 and a substantially cylindrical second wall 1040. The substantially cylindrical first wall 1030 has a diameter D1 larger than diameter D2 of second wall 1040. A flange 1025 ensures orientation pin 1000 will not be displaced downwardly through pin opening 218 in sleeve 210.

Figure 16:
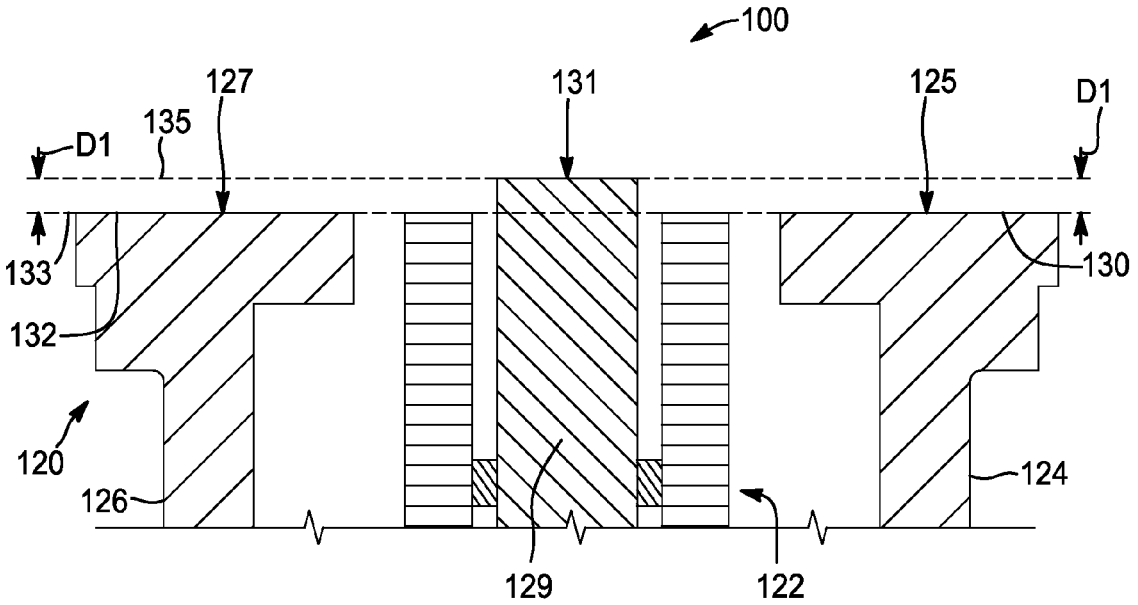
FIG. 16 illustrates a cross-section view taken along line 16-16 in FIG. 5.

Referring now to FIG. 16, a sectional view of the example switching rocker arm assembly 100 taken along line 16-16 in FIG. 5 is shown. Each of the first and second outer side arms 124, 126 has a high lift lobe contacting surface, such as first and second slider pads 130, 132, respectively. The high lift lobe contacting surfaces 130, 132 are configured to contact and interact with the high lift lobes 104, 106 during rotation of the cam 102. In some embodiments, the high lift lobe contacting surfaces 130, 132 may have a curved shape to complement the curved shape of the high lift lobes 104, 106 of cam 102. Further, the high lift lobe contacting surfaces 130, 132 can each include an uppermost point 125, 127, respectively, that defines an outer arm tangent plane 133.

Similar to the outer arm 120 described above, the inner arm 122 can include a low lift lobe contacting surface (such as roller assembly 129) that has an uppermost point 131. The low lift lobe contacting surface 129 may have a curved shape to complement the curved shape of the low lift lobe 108 of cam 102. The uppermost point 131 of low lift lobe contacting surface 129 can define an inner arm tangent plane 135 that is parallel to the outer arm tangent plane 133. As described more fully below, the inner and outer arm tangent planes 133, 135 can be spaced or offset from each other by a minimum distance D1, for example 0.1 millimeters.

As mentioned above, the inner and outer arms 122, 120 can be engaged together with a latch assembly, e.g., the latching mechanism 201. The latch assembly 201 can be arranged at least partially within the latch bore 240 of the inner arm 122. In a first configuration (e.g., a high-lift condition), the latch assembly 201 can engage the inner arm 122 with the outer arm 120 such that the outer arm 120 rotates with the inner arm 122. In a second configuration (e.g., a low-lift condition), the latch assembly 201 can disengage the inner arm 122 from the outer arm 120 such that the outer arm 120 rotates independently from the inner arm 122. In this manner, and more fully described above, the outer arm 120 can experience lost motion rotation with respect to the inner arm 122.

Figure 17:
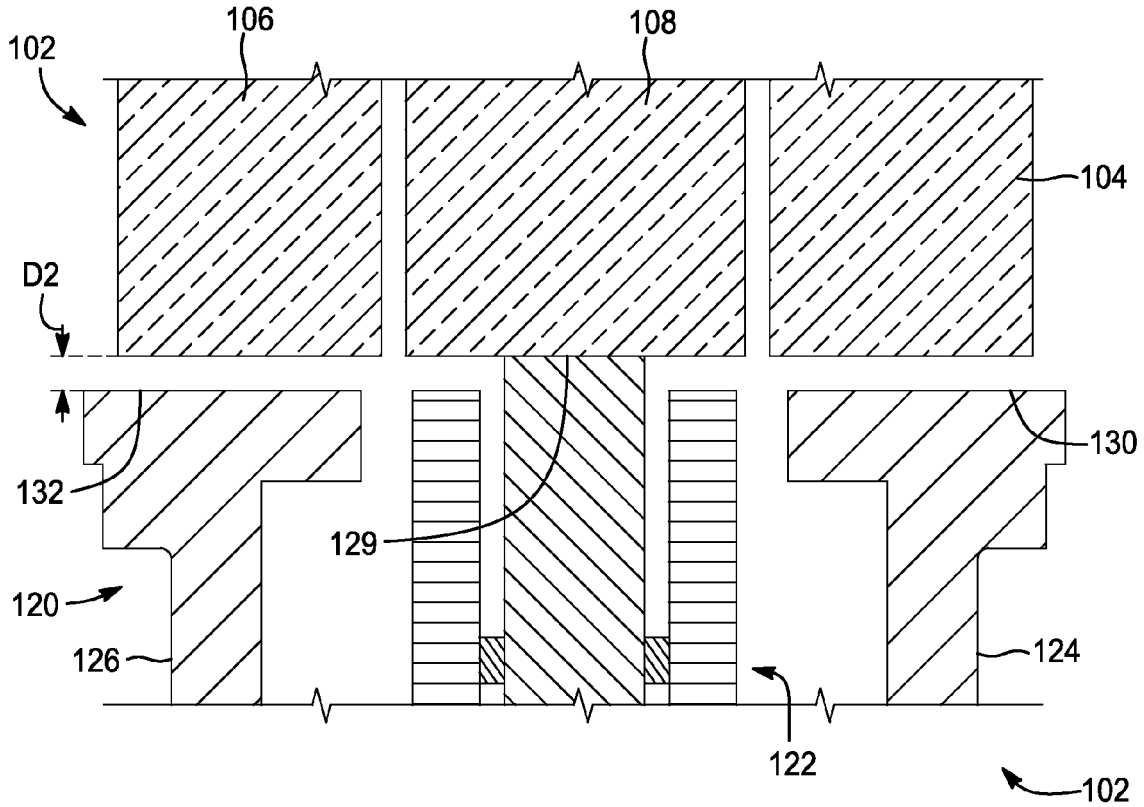
FIG. 17 illustrates a cross-section view of an exemplary switching rocker arm assembly 100 when arranged within an internal combustion engine and engaged with a cam 102 in a non-actuating condition.

Referring now to FIG. 17, a sectional view of the example switching rocker arm assembly 100 is shown when arranged within an internal combustion engine and engaged with a cam 102. During operation of an internal combustion engine, the cam 102 rotates such that the switching rocker arm assembly 100 (outer arm 120 and/or inner arm 122) is contacted by one or more of the low and high lift lobes 104, 106, 108 to switch between actuating and non-actuating conditions. In this manner, the switching rocker arm assembly 100 can be actuated by the cam 102, which may result in the opening of valve 112. It should be appreciated, however, that actuation of the switching rocker arm assembly 100 may occur and the valve 112 may remain in the closed position, e.g., as a result of lost motion rotation.

FIG. 17 illustrates the configuration of the switching rocker arm assembly 100 and cam 102 in the non-actuating condition. In the non-actuating condition, e.g., as shown in FIG. 1, the non-actuating portions 105 of the low and high lift lobes

Figure 18:
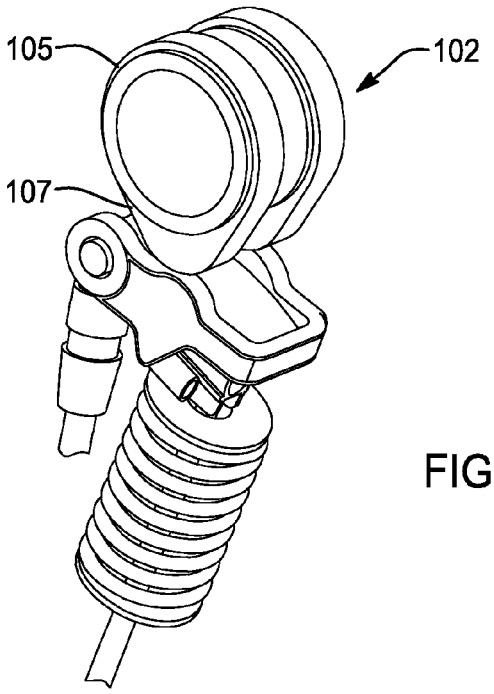
FIG. 18 a illustrates a perspective view of an exemplary switching rocker arm assembly 100 as it may be configured during operation with a three lobed cam 102 in a non-actuating condition.

104, 106, 108 are proximate the switching rocker arm assembly 100 and the valve 112 is closed. In the actuating condition, e.g., as shown in FIG. 18, the actuating portions 107 of the low and high lift lobes 104, 106, 108 are proximate the switching rocker arm assembly 100, which contacts one or more of the low and high lift lobes 104, 106, 108 such that the outer arm 120 and/or inner arm 122 rotates.

In the non-actuating condition, the non-actuating portions 105 of the high lift lobes 104, 106 may be in a spaced relation from the high lift lobe contacting surfaces 130, 132. For example only, the non-actuating portions 105 of the high lift lobes 104, 106 may be spaced from the high lift lobe contacting surfaces 130, 132 by a minimum distance D2 of approximately 0.1 millimeters. The non-actuating portion of the low lift lobe 108, however, may contact the low lift lobe contacting surface (such as roller assembly 129) such that lash or other undesirable interactions between the cam 102 and switching rocker arm assembly 100 are reduced.

Arrangement of the non-actuating portions 105 of the high lift lobes 104, 106 to be in a spaced relation from the high lift lobe contacting surfaces 130, 132 may be accomplished by spacing or offsetting the inner and outer arm tangent planes 133, 135 by the minimum distance D2. Alternatively, the low lift lobe 108 and high lift lobes 104, 106 may define respective tangent planes with their non-actuating portions 105 that are spaced or offset from each other by the minimum distance D2. It should be appreciated that a combination of offsetting the inner and outer arm tangent planes 133, 135 of the switching rocker arm assembly 100 by a specific distance and offsetting respective tangent planes of the non-actuating portions 105 of the low lift lobe 108 and high lift lobes 104, 106 by another specific distance may result in the non-actuating portions 105 of the high lift lobes 104, 106 to be in a spaced relation from the high lift lobe contacting surfaces 130, 132 by the minimum distance D2.

Figure 19:
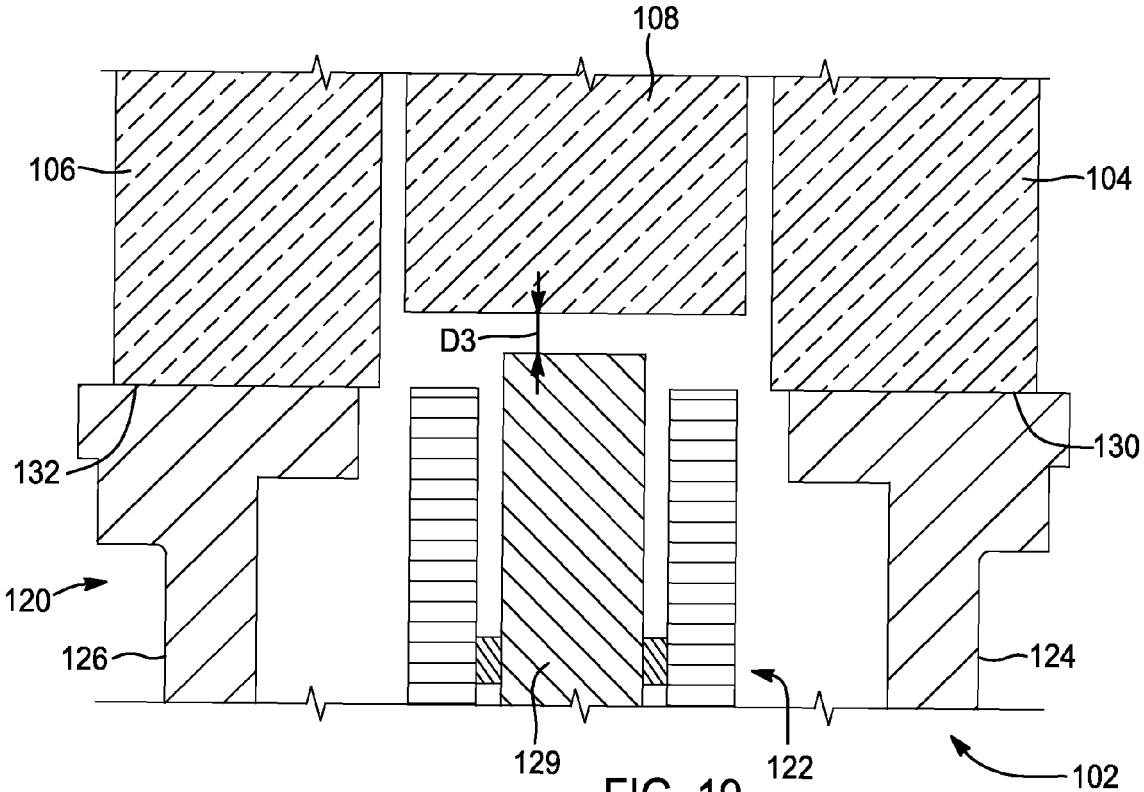
FIG. 19 illustrates a cross-section view of a switching rocker arm assembly 100 when arranged within an internal combustion engine and engaged with a cam 102 in an actuating condition.

FIG. 19 is a sectional view similar to FIG. 17 but showing the switching rocker arm assembly 100 and cam 102 in the actuating condition. More specifically, FIG. 19 illustrates the switching rocker arm assembly 100 and cam 102 in a first configuration in which the inner and outer arms 122, 120 are engaged such that the inner and outer arms 122, 120 rotate together. This first or "latched" configuration may correspond to a high lift condition in which the valve 112 is opened to a high or maximum amount. In the high lift condition, the actuating portion 107 of the high lift lobes 104, 106 may be brought into contact with the high lift lobe contacting surfaces 130, 132 during rotation of the cam 102. In some embodiments, and as shown in the example of FIG. 19, the actuating portion 107 of the low lift lobe 108 may be spaced from the low lift lobe contacting surface 129 by a distance D3.

In a second or "unlatched" configuration (not shown), the inner and outer arms 122, 120 are disengaged from each other such that the inner and outer arms rotate independently. This second or "unlatched" configuration may correspond to a low lift condition in which the valve 112 is opened to a specific amount less than the amount corresponding to the high lift condition. In the low lift condition, the actuating portion 105 of the low lift lobe 108 may be brought into contact with the low lift lobe contacting surface 129 during rotation of the cam 102. It should be appreciated that the second configuration may also correspond to a "no lift" condition in which the valve 112 remains closed when the switching rocker arm assembly 100 is actuated by the cam 102.

In either of the first and second configurations (latched or unlatched), during operation of the internal combustion engine the rotation of the cam 102 causes the actuating portion 107 of the high and/or low lift lobes 104, 106, 108 to interact with the switching rocker arm assembly 100 to rotate at least one of the inner and outer arms 122, 120, respectively. The spacing of the cam lobes (high and/or low lift lobes 104, 106, 108) from the contacting surfaces (low and/or high lift lobe contacting surfaces 129, 130, 132) of the switching rocker arm assembly 100 during a portion of engine cycle may reduce the frictional resistance between the switching rocker arm assembly 100 and the cam 102 during engine operation. Such a reduction in the frictional resistance may, e.g., result in more efficient engine operation such as an increase in miles per gallon of fuel.

It should be appreciated that, while the above description is directed to a switching rocker arm assembly 100 that has an outer arm 120 and an inner arm 122, as well as a cam 102 that has a low lift lobe 108 and two high lift lobes 104, 106, the present disclosure is applicable to other designs. For example, the switching rocker arm assembly 100 may include first and second arms that can be engaged with each other through a latch assembly 201 similar to that described above. Furthermore, the first arm may have a first lobe contacting surface and the second arm may have a second lobe contacting surface in a manner similar to the inner and outer arms 122, 120 having the low lift lobe contacting surface 129 and the high lift lobe contacting surface(s) 130, 132. The cam 102 may, for example, include a first lobe and a second lobe to interact with the first and second lobe contacting surfaces, respectively.

For the purposes of this disclosure and unless otherwise specified, "a" or "an" means "one or more." To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or multiple components. As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term. From about X to Y is intended to mean from about X to about Y, where X and Y are the specified values.

While the present disclosure illustrates various embodiments, and while these embodiments have been described in some detail, it is not the intention of the applicant to restrict or in any way limit the scope of the claimed invention to such detail. Additional advantages and modifications will readily appear to those skilled in the art. Therefore, the invention, in its broader aspects, is not limited to the specific details and illustrative examples shown and described. Accordingly, departures may be made from such details without departing from the spirit or scope of the applicant's claimed invention. Moreover, the foregoing embodiments are illustrative, and no single feature or element is essential to all possible combinations that may be claimed in this or a later application.

What is claimed is:

1. A rocker arm assembly that cooperates with a cam having a low lift lobe and two high lift lobes, each of the low and high lift lobes including an actuating portion and a non-actuating portion, the cam rotating during operation of the internal combustion engine such that the actuating portions interact with the rocker arm assembly to rotate at least one of the inner and outer arms, the rocker arm assembly comprising:

an outer arm having a first outer side arm and a second outer side arm, each of the first and second outer side arms having a high lift lobe contacting surface, each of the high lift lobe contacting surfaces having an uppermost point that defines an outer arm tangent plane;

an inner arm disposed between the first and second outer side arms and pivotably secured to the outer arm, the inner arm having a low lift lobe contacting surface and defining a latch bore, the low lift lobe contacting surface having an uppermost point that defines an inner arm tangent plane that is parallel to the outer arm tangent plane; and a latch assembly arranged at least partially within the latch bore of the inner arm, the latch assembly being movable between a first configuration and a second configuration, the latch assembly being configured to: (i) engage with the outer arm such that the outer arm rotates with the inner arm in the first configuration, and (ii) disengage the inner arm from the outer arm such that the outer arm rotates independently from the inner arm in the second configuration, wherein the inner arm tangent plane is spaced from the outer arm tangent plane by a minimum distance such that the non-actuating portions of the high lift lobes of the cam are offset from the high lift lobe contacting surfaces in a non-actuating condition and the actuating portion of the low lift lobe of the cam is offset from the low lift lobe contacting surface in an actuating condition.

2. The rocker arm assembly of claim 1, wherein the minimum distance is 0.1 millimeters.

3. The rocker arm assembly of claim 1, wherein the inner arm includes a roller assembly, the roller assembly comprising the low lift lobe contacting surface.

4. An internal combustion engine, comprising:

a lash adjuster mounted to an engine block;

a cylinder valve configured to selectively open and close an exhaust or intake passage;

a rocker arm assembly coupled to the lash adjuster at a first end and engaged with the cylinder valve at a second end opposite the first end, the rocker arm assembly comprising:

an outer arm having a first outer side arm and a second outer side arm, each of the first and second outer side arms having a high lift lobe contacting surface, an inner arm disposed between the first and second outer side arms and pivotably secured to the outer arm, the inner arm having a low lift lobe contacting surface, and a latch assembly selectively movable between a first configuration and a second configuration, the latch assembly being configured to: (i) engage the inner arm with the outer arm such that the outer arm rotates with the inner arm in the first configuration, and (ii) disengage the inner arm from the outer arm such that the outer arm rotates independently from the inner arm in the second configuration; and a cam having a low lift lobe and two high lift lobes, each of the low and high lift lobes including an actuating portion and a non-actuating portion, the cam rotating during operation of the internal combustion engine such that the actuating portions interact with the rocker arm assembly to rotate at least one of the inner and outer arms, wherein the non-actuating portions of the high lift lobes are in a spaced relation from the high lift lobe contacting surfaces such that the non-actuating portions of the high lift lobes of the cam are offset from the high lift lobe contacting surfaces in a non-actuating condition and the actuating portion of the low loft lobe of the cam is offset from the low lift lobe contacting surface in an actuating condition.

5. The internal combustion engine of claim 4, wherein the non-actuating portion of the low lift lobe contacts the low lift lobe contacting surface.

6. The internal combustion engine of claim 5, wherein the cylinder valve is opened to a low lift condition when the actuating portion of the low lift lobe is brought into contact with the low lift lobe contacting surface during rotation of the cam and the latch assembly is in the second configuration.

7. The internal combustion engine of claim 6, wherein the cylinder valve is opened to a high lift condition when the actuating portions of the high lift lobes are brought into contact with the high lift lobe contacting surfaces during rotation of the cam and the latch assembly is in the first configuration.

8. The internal combustion engine of claim 4, wherein:

each of the high lift lobe contacting surfaces has an uppermost point that defines an outer arm tangent plane;

the low lift lobe contacting surface has an uppermost point that defines an inner arm tangent plane that is parallel to the outer arm tangent plane; and the inner arm tangent plane is spaced from the outer arm tangent plane by a minimum distance.

9. The internal combustion engine of claim 8, wherein the minimum distance is 0.1 millimeters.

10. The internal combustion engine of claim 8, wherein the non-actuating portions of the high lift lobes are spaced from the high lift lobe contacting surfaces by at least the minimum distance.

11. The internal combustion engine of claim 8, wherein the inner arm includes a roller assembly, the roller assembly comprising the low lift lobe contacting surface.

12. The internal combustion engine of claim 4, wherein:

the non-actuating portion of the low lift lobe defines a first tangent plane;

each of the non-actuating portions of the high lift lobes defines a second tangent plane; and the first tangent plane is spaced from the second tangent plane by a minimum distance.

13. An internal combustion engine, comprising:

a lash adjuster mounted to an engine block;

a cylinder valve configured to selectively open and close an exhaust or intake passage;

a rocker arm assembly coupled to the lash adjuster at a first end and engaged with the cylinder valve at a second end opposite the first end, the rocker arm assembly comprising:

a first arm having a first lobe contacting surface, a second arm pivotably secured to the first arm and having a second lobe contacting surface, and a latch assembly selectively movable between a first configuration and a second configuration, the latch assembly being configured to: (i) engage the first arm with the second arm such that the second arm rotates with the first arm in the first configuration, and (ii) disengage the second arm from the first arm such that the second arm rotates independently from the first arm in the second configuration; and a cam having a first lobe and a second lobe, each of the first and second lobes including an actuating portion and a non-actuating portion, the cam rotating during operation of the internal combustion engine such that the actuating portions interact with the rocker arm assembly to rotate at least one of the first and second arms, wherein the non-actuating portion of the second lobe is in a spaced relation from the second lobe contacting surface in a non-actuating condition and wherein the actuating portion of the first lobe of the cam is offset from the first lobe contacting surface in an actuating condition.

14. The internal combustion engine of claim 13, wherein the non-actuating portion of the first lobe contacts the first lobe contacting surface.

15. The internal combustion engine of claim 14, wherein the cylinder valve is opened to a low lift condition when the actuating portion of the first lobe is brought into contact with the first lobe contacting surface during rotation of the cam and the latch assembly is in the second configuration.

16. The internal combustion engine of claim 15, wherein the cylinder valve is opened to a high lift condition when the actuating portion of the second lobe is brought into contact with the second lobe contacting surface during rotation of the cam and the latch assembly is in the first configuration.

17. The internal combustion engine of claim 13, wherein:

the first lobe contacting surface has an uppermost point that defines a first arm tangent plane;

the second lobe contacting surface has an uppermost point that defines a second arm tangent plane that is parallel to the first arm tangent plane; and the first arm tangent plane is spaced from the second arm tangent plane by a minimum distance.

18. The internal combustion engine of claim 17, wherein the minimum distance is 0.1 millimeters.

19. The internal combustion engine of claim 17, wherein the non-actuating portions of the second lobe is spaced from the second lobe contacting surface by at least the minimum distance.

20. The internal combustion engine of claim 13, wherein:

the non-actuating portion of the first lobe defines a first tangent plane;

the non-actuating portion of the second lobe defines a second tangent plane; and the first tangent plane is spaced from the second tangent plane by a minimum distance.

* * * * *